United States Patent [19]

Nomura et al.

[11] Patent Number: 4,704,073

[45] Date of Patent: Nov. 3, 1987

[54] SWASH-PLATE TYPE ROTARY COMPRESSOR WITH LUBRICATION OF SWASH PLATE AND PERIPHERAL PARTS THEREOF

[75] Inventors: Hiroshi Nomura; Mototaka Shitara; Susumu Echizen; Susumu Saito, all of Konan, Japan

[73] Assignee: Diesel Kiki Co., Ltd., Tokyo, Japan

[21] Appl. No.: 883,597

[22] Filed: Jul. 9, 1986

[30] Foreign Application Priority Data

Jul. 16, 1985 [JP] Japan ..... 60-157803

[51] Int. Cl.[4] ..... F04B 27/08; F01M 1/00

[52] U.S. Cl. ..... 417/269; 184/6.17

[58] Field of Search ..... 417/269; 184/6.17; 92/71

[56] References Cited

U.S. PATENT DOCUMENTS

| | | | |
|---|---|---|---|
| 4,412,787 | 11/1983 | Kondo et al. | 417/269 |
| 4,415,315 | 11/1983 | Shibuya | 417/269 |
| 4,596,518 | 6/1986 | Sumikawa | 417/269 |

FOREIGN PATENT DOCUMENTS

| | | | |
|---|---|---|---|
| 159711 | 12/1979 | Japan | 417/269 |
| 162218 | 12/1979 | Japan | 417/269 |
| 162219 | 12/1979 | Japan | 417/269 |
| 19917 | 2/1980 | Japan | 417/269 |
| 27091 | 3/1981 | Japan | 417/269 |

*Primary Examiner*—Carlton R. Croyle
*Assistant Examiner*—Paul F. Neils
*Attorney, Agent, or Firm*—Frishauf, Holtz, Goodman & Woodward

[57] ABSTRACT

A swash-plate type rotary compressor includes a plurality of cylinders disposed in circumferentially equi-distantly spaced relation to each other around a drive shaft having mounted thereon a swash plate for rotation therewith. The swash plate is rotated to cause pistons to be slidingly reciprocated in the respective cylinders to draw gas containing lubricant and to compress same. Guide walls are provided on both sides of a swash plate chamber for guiding gas introduced into the swash plate chamber to flow over entire side surfaces of the swash plate from an outer periphery toward a center thereof. A plurality of gas guiding passageways are each located between each pair of adjacent cylinders, for guiding the gas flowing to a central portion of the swash plate into at least one low pressure space.

6 Claims, 5 Drawing Figures

SWASH-PLATE TYPE ROTARY COMPRESSOR WITH LUBRICATION OF SWASH PLATE AND PERIPHERAL PARTS THEREOF

BACKGROUND OF THE INVENTION

The present invention relates to a swash-plate type rotary compressor such as a refrigerant compressor for use in an air conditioning system for vehicles.

In general, a swash-plate type rotary compressor is known in which a plurality of cylinders are disposed in circumferentially equi-distantly spaced relation to each other around a rotary shaft having mounted thereon a swash plate for rotation therewith and the swash plate is rotated to cause pistons to be slidingly reciprocated within the respective cylinders, to thereby compress gas or compression medium containing lubricating oil. In a compressor of this type, it is a requisite to lubricate balls and shoes through which the swash plate is engaged with the pistons, and to lubricate thrust bearings on the opposite sides of a central hub of the swash plate.

For this purpose, heretofore, as shown in FIG. 1, guide walls 2 and 3 are provided at an upper half portion of a swash plate chamber 1 and respectively on the opposite sides thereof. Gas or refrigerant drawn from a suction port 4 flows toward the swash plate chamber 1 through a low pressure passage 5 and an inlet bore 6*a* formed in a rear valve plate 6. The guide walls 2 and 3 serve to guide the gas to flow along opposite surfaces of the swash plate 1 from an outer periphery toward a center thereof. Subsequently, the gas is introduced into low pressure spaces 8 and 8 respectively through an outlet bore 7*a* formed in a front valve plate 7 and an outlet bore 6*b* formed in the rear valve 6. This enables the oil in the gas to be brought into contact with balls and shoes (not shown), and thrust bearings 10 and 11 on opposite sides of a central hub 9*a* of a swash plate 9, to thereby lubricate these components.

In such conventional compressor constructed as above, since the guide walls 2 and 3 are provided only at the upper half portion of the swash plate chamber 1 on the opposite sides thereof, a portion of the swash plate 9 located in the upper half portion of the swash plate chamber 1 is lubricated, but a portion of the swash plate 9 located in a lower half portion of the swash plate chamber 1 is not sufficiently lubricated. In addition, since the guide walls 2 and 3 are located remotely above the thrust bearings 10 and 11, only a small amount of gas flows to the central portion of the swash plate 9, and accordingly satisfactory oil lubrication is not effected of the balls and shoes, the thrust bearings, etc.

OBJECT AND SUMMARY OF THE INVENTION

It is an object of the present invention to provide a swash-plate type rotary compressor in which compression medium containing lubricant is caused to flow over entire opposite faces of a swash plate to enable efficient lubrication of all of balls, shoes and thrust bearings.

According to the present invention, there is provided a swash-plate type rotary compressor comprising:

a housing having defined therein a swash plate chamber and at least one low pressure space communicating therewith;

a drive shaft rotatably mounted in the housing and extending through the swash plate chamber;

a swash plate disposed in the swash plate chamber and mounted on the drive shaft for rotation therewith;

a plurality of cylinders disposed around the drive shaft in circumferentially equi-distantly spaced relation to each other;

pistons slidably received in respective ones of the cylinders and operatively engaged with the swash plate in a manner such that rotation of the swash plate causes the pistons to be reciprocated within the respective cylinders to draw compression medium into the cylinders and compress same;

said at least one low pressure space being disposed for communication with the interior of said cylinders;

a pair of guide walls provided in the housing at opposite sides of the swash plate chamber for guiding gas introduced into the swash plate chamber, and disposed to cause the compression medium to flow over entire side sufaces of the swash plate from an outer periphery toward a diametric center thereof; and a plurality of medium guiding passageways each located between each pair of adjacent one of the cylinders, for guiding compression medium flowing to a central portion of the swash plate into the at least one low pressure space.

The above and other objects, features and advantages of the invention will become more apparent from the ensuing detailed description taken in conjunction with the accompanying drawings.

DETAILED DESCRIPTION

Figure 2:
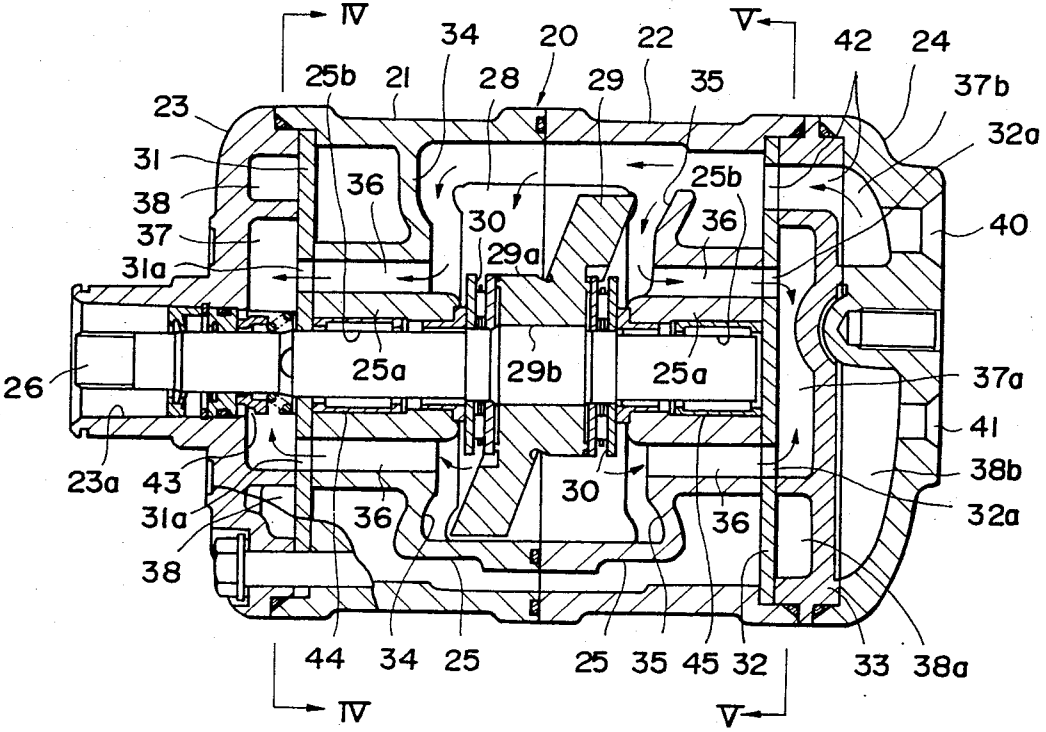
FIG. 2 is a longitudinal cross-sectional view taken along lines II—II in FIGS. 4 and 5, showing a swash-plate type rotary compressor in accordance with an embodiment of the invention.
Figure 3:
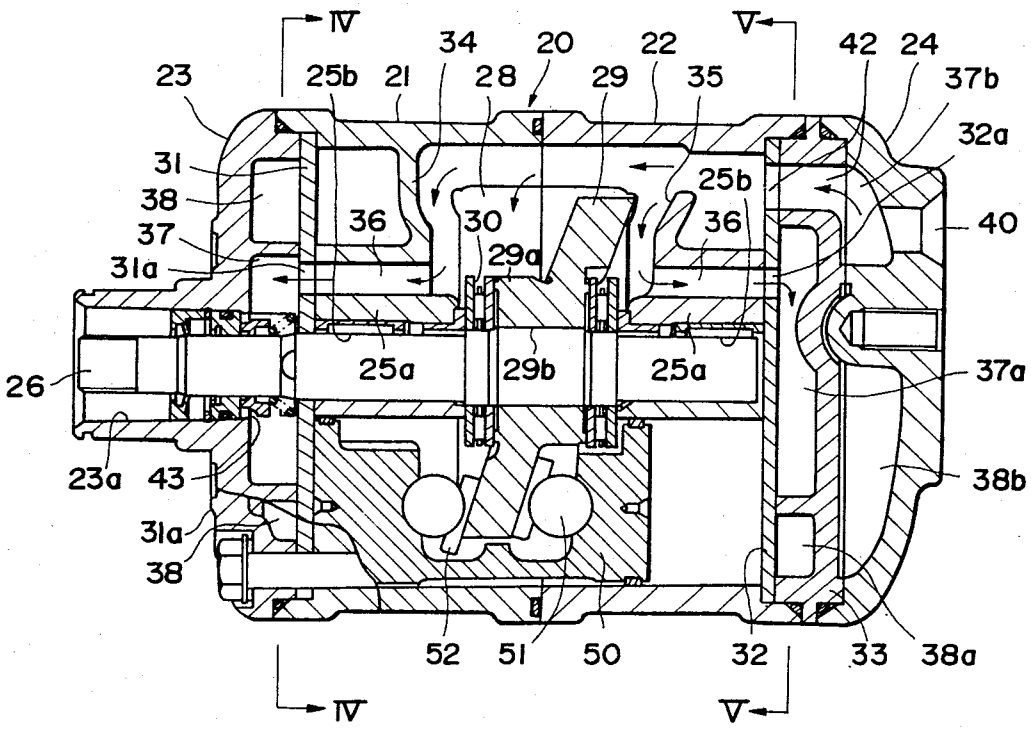
FIG. 3 is a transverse cross-sectional view of the swash-type rotary compressor of FIG. 2, taken along lines II—II in FIGS. 4 and 5, showing a section of a piston.
Figure 4:
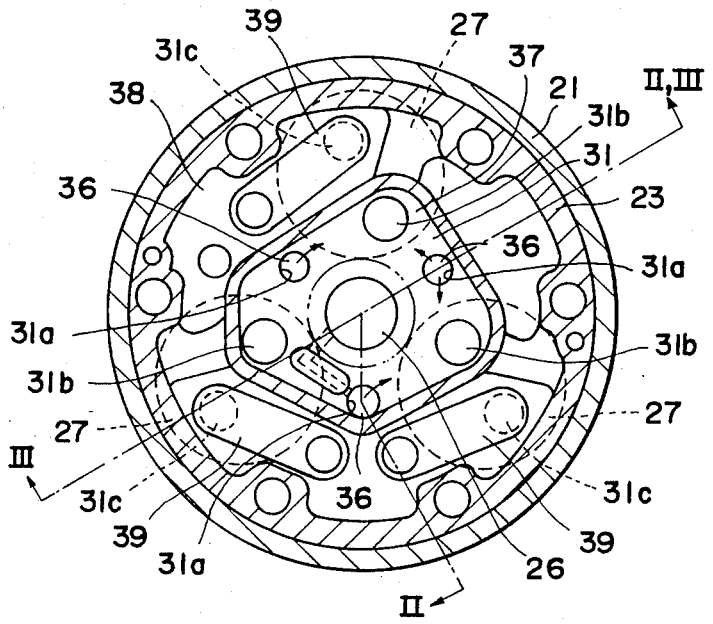
FIG. 4 is a transverse cross-sectional view taken along lines IV—IV in FIGS. 2 and 3.
Figure 5:
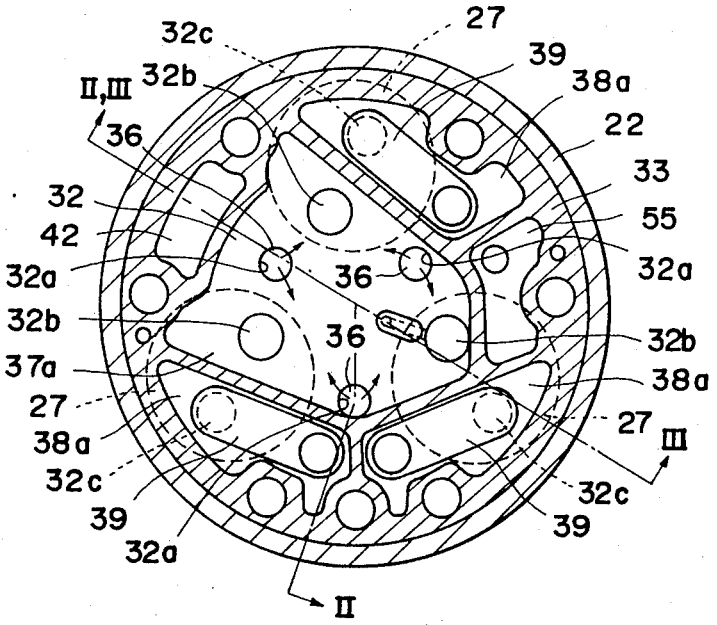
FIG. 5 is a transverse cross-sectional view taken along lines V—V in FIGS. 2 and 3.

The invention will be described in detail with reference to FIGS. 2 through 5 of the drawings showing an embodiment thereof. FIG. 2 shows a swash-plate type rotary compressor in accordance with the embodiment of the invention. The rotary compressor comprises a housing 20 which includes a pair of cylindrical casing elements 21 and 22 substantially symmetrical in configuration to each other and joined to each other in an abutting and aligned manner, and front and rear heads 23 and 24 mounted respectively on open ends of the respective casing elements 21 and 22. Cylinder blocks 25 are integrally formed within the respective casing elements 21 and 22. As shown in FIGS. 4 and 5, a plurality of (three in the illustrated embodiment) cylinders 27 are formed in each of the cylinder blocks 25 in such a manner that the cylinders 27 have their respective axes extending parallel to the axis of a drive shaft 26 and are arranged in circumferentially equi-distantly spaced relation to each other. A swash plate chamber 28 is defined by the cylinder blocks 25 at an axially intermediate location of the housing 20. The drive shaft 26 axially extends substantially along the central axis of the housing 20. An axial portion of the drive shaft 26 between one end of the drive shaft 26 and a substantially axially central portion thereof is rotatably fitted in and supported by a central bore 25b in a hub 25a of the cylinder block 25 within one of the casing elements 21. The other axial end portion of the drive shaft 26 is rotatably fitted in and supported by a central bore 25b in a hub 25a of the cylinder block 25 within the other casing element 22.

A swash plate 29 is rotatably disposed within the swash plate chamber 28 and is mounted on the drive shaft 26 for rotation therewith in such a manner that the substantially axially central portion of the drive shaft 26 is fitted in a central bore 29b in a hub 29a of the swash plate 29. Each of double headed pistons 50 shown in FIG. 3 has formed therein a central recess having front and rear surfaces slidably engaged respectively with front and rear faces of the swash plate 29 through balls 51 and shoes 52 shown in FIG. 3. Each of the pistons is slidably fitted in the corresponding cylinder 27 for reciprocating movement therein during rotation of the swash plate 29. Each of thrust bearings 30 is interposed between an end face of the hub 25a of the corresponding cylinder block 25 and corresponding one of opposite end faces of the hub 29a of the swash plate 29.

A front valve plate 31 is interposed between the one casing element 21 and the front head 23, and a rear valve plate 32 and a spacer member 33 are interposed between the other casing element 22 and the rear head 24 in an abutting and aligned manner.

Guide walls 34 and 35 are formed integrally with the respective casing element 21, 22 and located in the swash plate chamber 28 at opposite sides of the swash plate chamber 28, for guiding gas or compression medium containing lubricating oil so as to flow over the entire side surfaces of the swash plate 29 from an outer periphery toward a diametric center thereof. In the illustrated embodiment, a pair of such guide walls 34, 35 are provided in the swash plate chamber 28 at a circumferential location corresponding to a suction passageway 42, hereinafter referred to. The guide wall 34 is disposed at a circumferential location intermediate between a particular pair of adjacent cylinders 27 on the front side, and the guide wall 35 is disposed at a circumferential location intermediate between a particular pair of adjacent cylinders 27 on the rear side, corresponding to the particular pair of the cylinders on the front side 27. The guide wall 34 on the front side extends radially inwardly from an inner peripheral wall of the casing element 21 defining the swash plate chamber 28, with a radially inner end portion thereof being rearwardly curved toward a peripheral portion of the swash plate 29. The guide wall 35 on the rear side extends radially outwardly but obliquely or rearwardly from an outer peripheral portion of the hub 25a of the cylinder block 25 on the rear side, and terminates in an internal space within the swash plate chamber 28 at the same level as an open end of the suction passageway 42 opening into the swash plate chamber 28.

Gas guiding passageways 36 are provided in an outer peripheral portion of the hub 25a of each of the cylinder blocks 25 of the respective casing elements 21 and 22. Each passageway 36 is located at a circumferential location intermediate between a corresponding pair of adjacent cylinders 27. And a pair of the gas guiding passageways 36 are located immediately below the respective guide walls 34, 35 and each have an open end facing the swash plate 29 at a diametrically central portion thereof such that the shoes 52 slide on the side surfaces of the swash plate 29 immediately after suction gas passes over the side surfaces of the swash plate 29. The gas guiding passageways 36 have their respective axes extending parallel to the axis of the drive shaft 26. The gas guided by the guide walls 34 and 35 to flow to the diametrically central portion of the swash plate 29 is led through the gas guiding passageways 36 into low pressure spaces or low pressure chambers 37 and 37a defined, respectively, between the front valve plate 31 and the front head 23 and between the rear valve plate 32 and the spacer member 33. Through holes 31a are formed in the front valve plate 31 in aligned relation to the respective gas guiding passageways 36 on the front side to communicate the latter with the low pressure chambers 37. Similarly, through holes 32a are formed in the rear valve plate 32 in aligned relation to the respective gas guiding passageways 36 on the rear side to communicate the latter with the low pressure chambers 37a. High pressure spaces high pressure chambers 38 and 38a are defined, respectively, between the front head 23 and the front valve plate 31 and between the spacer member 33 and the rear valve plate 32 and are located radially outwardly of the respective low pressure spaces 37 and 37a. The low pressure spaces 37 and 37a are in communication with the cylinders 27, respectively, through suction bores 31b and 32b formed in the respective valve plates 31 and 32 and through suction valves (not shown), each suction bore 31b, 32b and each suction valve being associated with corresponding one of the cylinders 27. The high pressure spaces 38 and 38a are in communication with the cylinders 27, respectively, through discharge bores 31c and 32c formed in the respective valve plates 31 and 32 and through discharge valves 39, each discharge bore 31c, 32c and each discharge valve being associated with coresponding one of the cylinders 27. The rear head 24 is formed therein with a suction port 40 and a discharge port 41. The suction port 40 is in communication with the front and rear low pressure chambers 37 and 37a through a suction space 37b defined between the rear head 24 and the spacer member 33, and is in communication with the swash plate chamber 28 through the suction passageway 42 extending through the spacer member 33 and the rear velve plate 32. The discharge port 41 is in communication with the high pressure space 38a on the rear side through a high pressure space 38b defined between the rear head 24 and the spacer member 33, and in communication with the high pressure space 38 on the front side through the high pressure space 38b and a discharge passageway 55 extending through the cylinder blocks 25 and communicating with the front high pressure chamber 38.

Figure 1:
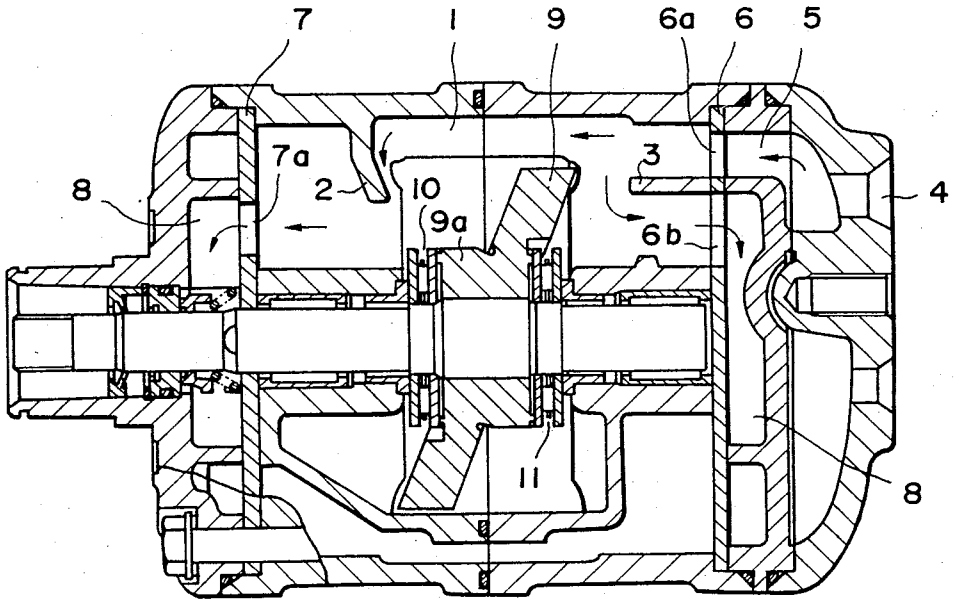
FIG. 1 PRIOR ART
FIG. 1 is a longitudinal cross-sectional view showing a conventional swash-plate type rotary compressor.

As shown in FIG. 1, a seal assembly 43 is disposed in a bore 23a in a hub of the front head 23 and fitted around the drive shaft 26 to seal between the bore 23d and the drive shaft 26. Radial bearings 44 and 45 are disposed respectively between the outer peripheral surface of the drive shaft 26 and the central bores 25b in the hubs 25a of the cylinder blocks 25 of the respective casing elements 21 and 22.

The operation of the swash-plate type rotary compressor constructed as above in accordance with the invention will now be described. When the swash plate 29 is rotated together with the drive shaft 26, the pistons engaging with the swash plate 29 are reciprocated within their respective cylinders 27. When each of the pistons is moving through a suction stroke on the front side, gas containing lubricating oil (refrigerant gas or the like) flows from the suction port 40 into the front low pressure space 37 successively through the rear low pressure space 37*b*, the suction passageway 42, the swash plate chamber 28, the gas guiding passageways 36, and the through holes 31*a*, and is drawn into the cylinders 27 on the front side through the respective suction bores 31*b* and the respective suction valves (not shown). When the pistons are subsequently moving through a compression stroke on the front side, the drawn gas is compressed, and the compressed gas is forced into the front high pressure space 38 through the respective discharge bores 31*c* and the respective discharge valves 39 on the front side, and is discharged from the discharge port 41 successively through the discharge passageway 55 and the high pressure spaces 38*a* and 38*b* on the rear side. The pistons performs strokes on the rear side in a manner similar to that state above, alternately with those preformed by the pistons on the front side. The operation of the suction and compression strokes is identical with the conventional one.

During the above-described suction and compression strokes, a portion of the gas drawn through the suction port 40 into the rear suction space 37*b* is introduced into the swash plate chamber 28 through the suction passageway 42. Subsequently, the gas is guided by the opposite guide walls 34 and 35 to flow over the entire opposite side surfaces of the swash plate 29 from the outer periphery toward the diametric center thereof as indicated by arrows in FIG. 2. This causes lubricating oil in the gas flowing radially inwardly toward the drive shaft 26, to be sufficiently brought into contact with the balls 51 and shoes 52 through which each of the opposite side surfaces of the swash plate 29 is engaged with the correponding pistons, and also to be sufficiently brought into contact with the thrust bearings 30 at the opposite sides of the central hub 29*a* of the swash plate 29. Thus, these components are efficiently lubricated, and the outer periphery of the drive shaft 26 is also lubricated. The gas guided to flow from the outer periphery of the swash plate 29 toward the diametric center thereof by the guide walls 34 and 35 is led into the low pressure spaces 37*a* through the gas guiding passageways 36 and the through bores 31*a* and 32*a* in the respective valve plates 31 and 32.

Since the gas guiding passageways are located between adjacent ones of the cylinders 27 such that the shoes 51 slide on the side surfaces of the swash plate 29 immediately after gas passes over the side surfaces of the swash plate 29, it is possible to lubricate the balls and shoes further efficiently.

While a preferred embodiment of the invention has been described, variations thereto will occur to those skilled in the art within the scope of the present inventive concepts which are delineated by the following claims.

What is claimed is:

1. A swash-plate type rotary compressor comprising:

a housing having defined therein a swash plate chamber and at least one pair of low pressure spaces at the front and rear sides, respectively, of said swash plate chamber and communicating therewith;

a drive shaft rotatably mounted in said housing and extending through said swash plate chamber;

a swash plate disposed in said swash plate chamber an mounted on said drive shaft for rotation therewith;

a plurality of cylinders disposed around said drive shaft in circumferentially equi-distantly spaced relation to each other;

pistons slidably received in respective ones of said cylinders and operatively engaged with said swash plate such that rotation of said swash plate causes the pistons to be reciprocated within the respective cylinders to draw compression medium into said cylinders and compress same;

a suction port formed in said housing and communicating with said at least one pair of low pressure spaces through said swash plate chamber;

a discharge port formed in said housing for communication with said plurality of cylinders for discharging therethrough the medium compressed within said cylinders;

said at least one pair of low pressure spaces being disposed for communication with the interior of said cylinders;

a pair of guide walls provided in said housing at opposite sides of the swash plate chamber for guiding gas introduced into said swash plate chamber, and disposed to cause the compression medium to flow over entire side surfaces of said swash plate from an outer periphery toward a diametric center thereof; and a plurality of compression medium guiding passageways each located between each pair of adjacent ones of said cylinders, for guiding compression medium flowing to a central portion of said swash plate into said at least one pair of low pressure spaces;

said compression medium guiding passageways each having an open end facing said swash plate at a diametrically central portion thereof.

2. A swash-plate type rotary compressor as defined in claim 1, wherein said compression medium guiding passageways include one pair of compression medium guide passageways located immediately below respective ones of said guide walls.

3. A swash-plate type rotary compressor as defined in claim 1, including a pair of cylinder blocks formed integrally with said housing and defining said swash plate chamber at an axially intermediate location thereof, said cylinder blocks each having a hub through which said drive shaft extends, and wherein said compression medium guiding passageways are each formed in said hub of a corresponding one of said cylinder blocks.

4. A swash-plate type rotary compressor as defined in claim 1, including:

a plurality of pairs of balls and shoes through which said swash plate is engaged with said pistons, said shoes being disposed in slidable contact with said side surfaces of said swash plate; and said compression medium guiding passageways each being located between adjacent ones of said cylinders in a manner such that said shoes slide on the side surfaces of said swash plate immediately after gas having been guided by said guide walls passes over the side surfaces of said swash plate.

5. A swash-plate type rotary compressor as defined in claim 4, wherein said pair of guide walls are located between a particular pair of adjacent ones of said cylinders.

6. A swash-plate type rotary compressor as defined in claim 5, wherein said cylinders comprise:

a plurality of second cylinders disposed on the other side of said swash plate in opposed and aligned relation to the respective first cylinders;

one of said guide walls being located between a particular pair of adjacent ones of said first cylinders, and the other one of said guide walls being located between a particular pair of adjacent ones of said second cylinders corresponding to said particular pair of said adjacent ones of said first cylinders.

* * * * *

UNITED STATES PATENT AND TRADEMARK OFFICE

CERTIFICATE OF CORRECTION

PATENT NO. : 4,704,073

DATED : Nov. 3, 1987

INVENTOR(S) : NOMURA et al

It is certified that error appears in the above-identified patent and that said Letters Patent is hereby corrected as shown below:

Column 6, claim 6, insert lines 3 and 4 to read -- a plurality of first cylinders disposed on one side of said swash plate; and --

Signed and Sealed this

Twelfth Day of July, 1988

*Attest:*

DONALD J. QUIGG

*Attesting Officer*

*Commissioner of Patents and Trademarks*